United States Patent [19]

Mercier

[11] 4,171,579

[45] Oct. 23, 1979

[54] INSTALLATION FOR DRYING A LIQUID-CONTAINING PARTICULATE PRODUCT

[75] Inventor: André Mercier, La Madeleine, France

[73] Assignee: Fives-Cail Babcock, Paris, France

[21] Appl. No.: 869,803

[22] Filed: Jan. 16, 1978

[51] Int. Cl.[2] ..... F26B 17/30

[52] U.S. Cl. ..... 34/58; 34/126; 233/1 R

[58] Field of Search ..... 233/1 R, 27; 210/237; 34/58, 8, 126, 130

[56] References Cited

U.S. PATENT DOCUMENTS

| | | | |
|---|---|---|---|
| 1,337,170 | 4/1920 | Wachenberg | 210/237 |
| 2,639,811 | 5/1953 | Sando et al. | 210/237 |
| 3,742,611 | 7/1973 | Koller | 34/8 |

FOREIGN PATENT DOCUMENTS

| | | | |
|---|---|---|---|
| 1098770 | 3/1955 | France | 34/58 |
| 1115953 | 1/1956 | France | 34/58 |
| 1124296 | 1/1956 | France | 34/58 |

*Primary Examiner*—John J. Camby
*Assistant Examiner*—Larry I. Schwartz
*Attorney, Agent, or Firm*—Kurt Kelman

[57] ABSTRACT

An installation for drying a liquid-containing particulate product comprises a supporting frame, a centrifugal separator removably mounted thereon and a large receptacle for the particles ejected from a discharge end of the separator basket supported on the supporting frame. The receptacle has a vertical wall defining an opening and the centrifugal separator is mounted for rotation about a horizontal axis and is arranged with the discharge end of the basket facing the opening in the vertical wall and extending into the receptacle whereby the particles are ejected into the receptacle upon rotation of the basket, the opening having a diameter slightly in excess of the diameter of the discharge end of the basket. The separator may thus be horizontally moved for placing it in position with the discharge end extending into the receptacle and for removing it without dismounting the receptacle.

15 Claims, 5 Drawing Figures

INSTALLATION FOR DRYING A LIQUID-CONTAINING PARTICULATE PRODUCT

The present invention relates to an installation for continuously drying a liquid-containing particulate product, which comprises a generally conventional centrifugal separator including a basket mounted for rotation about a horizontal axis and a filtering screen arranged in the basket for separating the liquid from the particles of the product, the basket having a discharge end and the particles moving along the screen and being ejected through the discharge end of the basket. If the basket is conical, the particles are moved along the screen and are ejected through the discharge end upon rotation of the basket under centrifugal force. If the basket is only slightly conical or cylindrical, a plunger may move the particles out of the discharge end.

Since the rotary velocity of the basket must be quite high to obtain efficient drying, i.e., effective separation of the liquid from the particles, the dry particles are ejected from the discharge end of the basket at high speed and tend to impact forcefully upon the wall of the tank which surrounds the basket and wherein it rotated. This violent impact causes the particles to break up, forming fines which may interfere with the further treatment to which the particles are subjected. This is particularly the case with cane or beet sugar that must be refined. Therefore, such sugar for the refinery is generally obtained by drying the massecuite in batch driers in repeated cycles although the investment and operating costs of such batch driers are considerably higher than for continuous driers.

To remedy the above-noted shortcoming of continuous driers, it has been proposed to eject the particles from the drying basket into a receptacle of large enough dimensions to enable the particles to be slowed down by air friction from their initial ejection speed to a speed upon impact on the receptacle wall which will no longer cause them to break on contact with the wall. Such a large receptacle is cumbersome and it is desirable to be able to utilize it maximally to make it useful.

It is the primary object of this invention to provide an installation of the indicated type with a large receptacle for the ejected particles which may be used practically without downtime while the centrifugal separator is removed for necessary maintenance work.

This and other objects of the invention are accomplished with a drying installation which comprises two independent parts: a centrifugal separator which may be easily and rapidly removed and replaced, and a stationary receptacle which carries the means for delivering the liquid-containing particulate product to the separator as well as for purging the product. By placing a separator in reserve, the operating separator may be periodically replaced to subject it to necessary maintenance work without interrupting the drying installation except during the time required for the replacement of the operating separator by the reserve separator. This is particularly useful in an installation comprising several separators in service and one in reserve.

The installation of the present invention comprises a supporting frame, a centrifugal separator removably mounted on the supporting frame, conduit means for delivering the liquid-containing particulate product to the separator, a large receptacle for the particles supported on the supporting frame, and means for horizontally moving the centrifugal separator. The separator includes a basket mounted for rotation about a horizontal axis and a filtering screen arranged in the basket for separating the liquid from the particles of the product, the basket having a discharge end and the particles moving along the screen and being ejected through the discharge end of the basket. The large receptacle includes a vertical wall defining an opening, and the centrifugal separator is arranged with the discharge end of the basket facing the opening in the vertical wall and extending into the receptacle whereby the particles are ejected into the receptacle, the opening having a diameter slightly in excess of the diameter of the discharge end of the basket. This enables the moving means to move the separator horizontally for placing the separator in position with the discharge end extending into the receptacle and for removing it without diassembling the receptacle.

The above and other objects, advantages and features of this invention will become more apparent from the following detailed description of now preferred embodiments thereof, taken in conjunction with the accompanying schematic drawing wherein FIG. 1 is side elevational view of a drying installation according to the invention;

Figure 2:
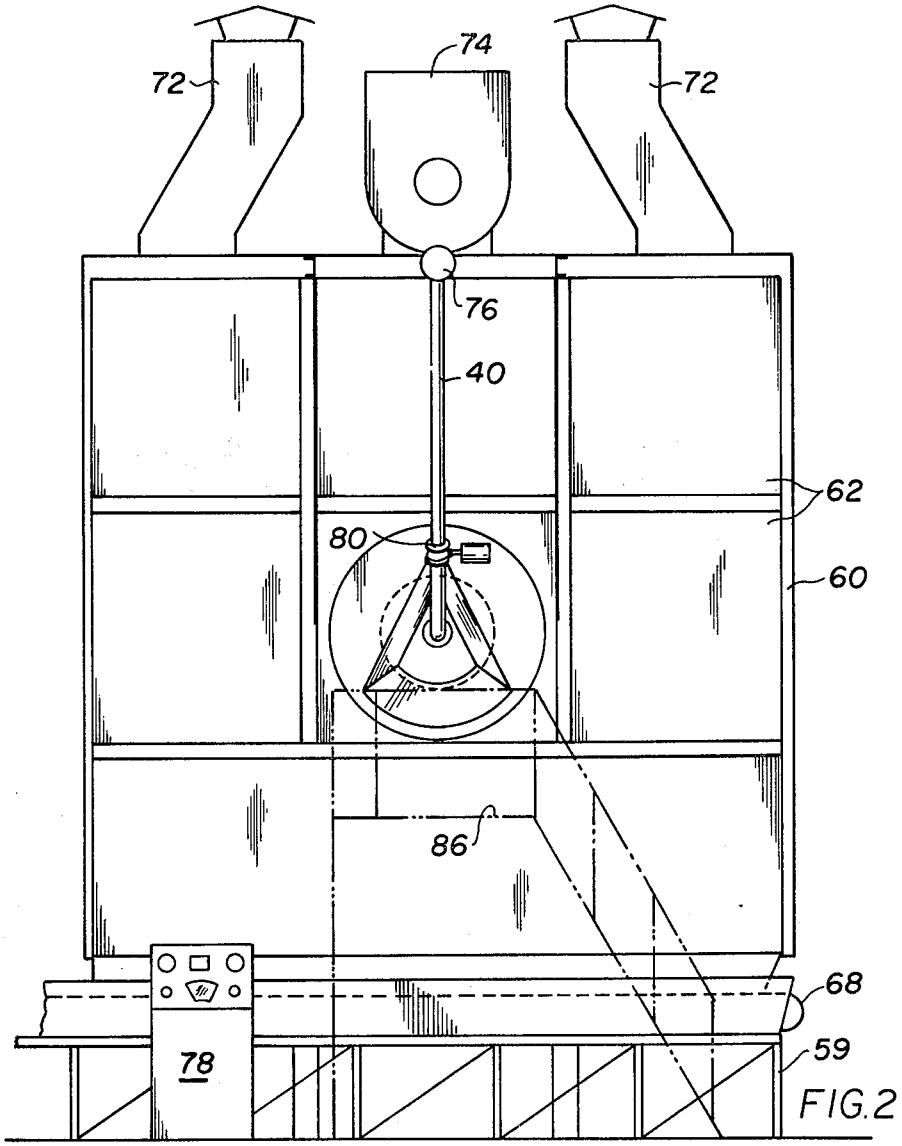
FIG. 2 is a front view of the installation, seen from the left in FIG. 1.
Figure 1:
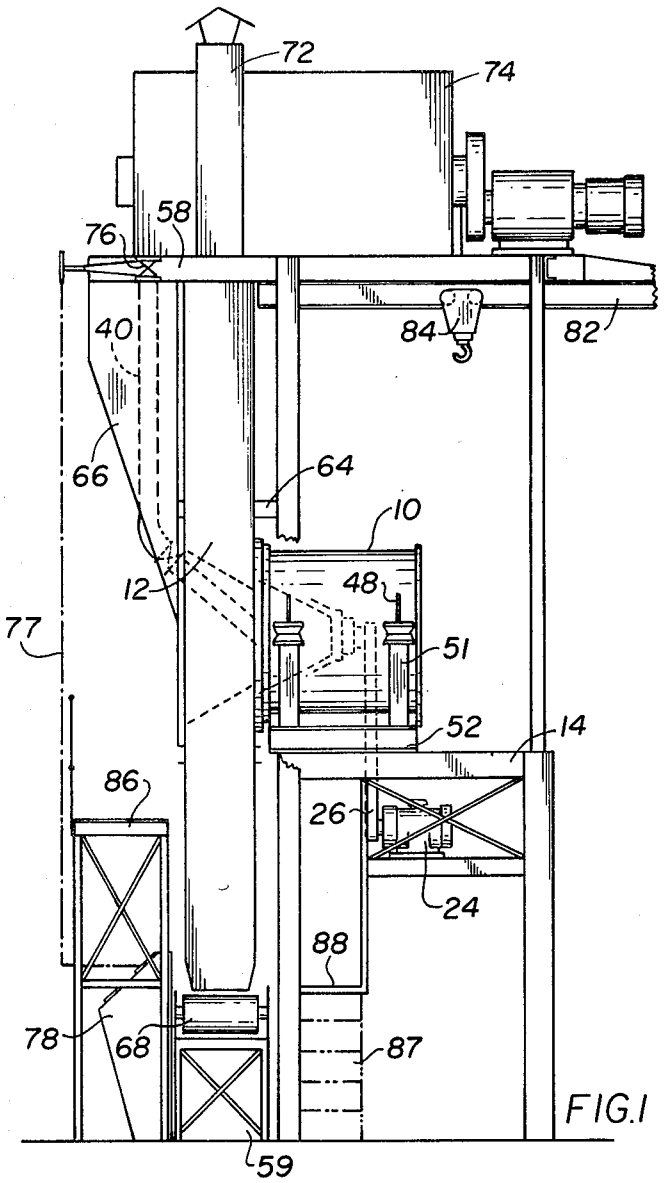

Referring now to the drawing and first to FIGS. 1 and 2, the illustrated embodiment of an installation for continuously drying a liquid-containing particulate product is shown to comprise essentially supporting frame 14 whereon centrifugal separator 10 is removably mounted and which supports large receptacle 12 for the particles separated from the liquid in the product delivered to the separator for drying.

Figure 3:
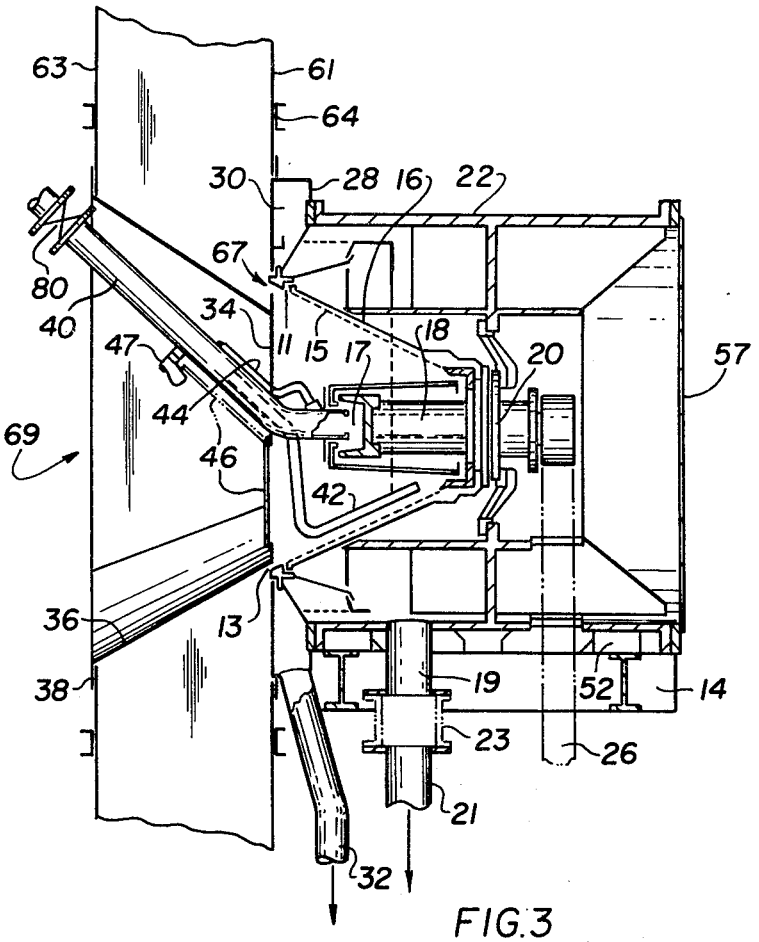
FIG. 3 is a transverse cross section showing the centrifugal separator and a portion of the large receptacle of the installation, taken in a plane containing the horizontal axis of rotation of the separator basket.

The centrifugal separator, which is generally conventional and whose specific structure may vary greatly and forms no part of the present invention, will be described hereinafter in more detail in connection with FIGS. 3 and 4. Essentially, it includes conical basket 16 mounted for rotation about a horizontal axis and filtering screen 15 arranged in the basket for separating the liquid from the particles of the product, the basket having a discharge end 13 and the particles moving along screen 15 and being ejected through the discharge end of the basket upon rotation thereof and by the centrifugal force generated by the rotation. The conical basket is mounted for rotation on stub shaft 18 affixed to support base 20 carried by tank 22 which surrounds the basket and is arranged to receive the separated liquid from filtering screen 15. The basket is rotated by motor 24, which is mounted on supporting frame 14 and whose output shaft is coupled to the rotary shaft of basket 16 by transmission belt 26, the transmission belt passing through slots in the wall of tank 22. All of this structure and the operation of the centrifugal separator are generally known, continuous drying in such separators being more fully described and illustrated, for example, in my U.S. Pat. No. 3,821,857, dated July 2, 1974.

Figure 4:
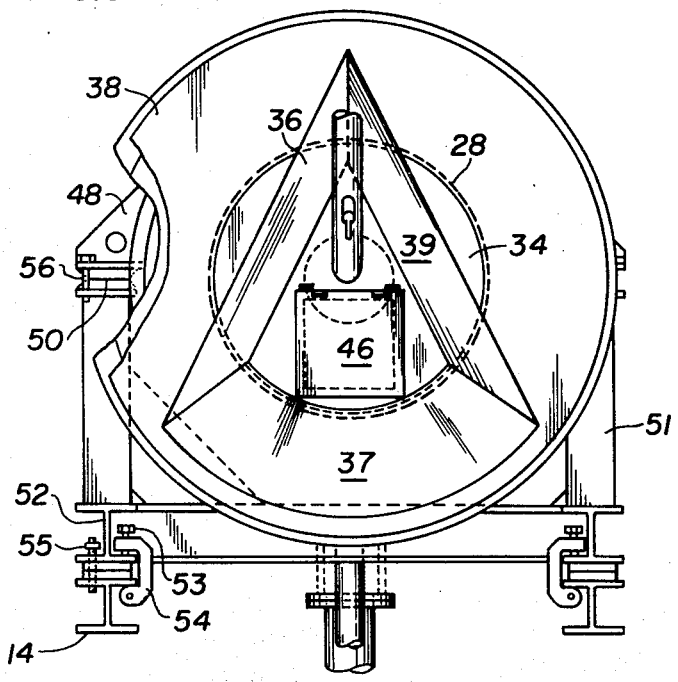
FIG. 4 is an enlarged front view showing the discharge end of the separator basket and the wall elements of the receptacle supporting the produce delivery conduit means and the liquid removal means, as well as the elastic support for the separator.

In the preferred embodiment illustrated herein, the centrifugal separator 10 is resiliently mounted on the supporting frame in the following manner:

Carrier frame 52 for the separator is mounted on supporting frame 14 by means for readily attaching the carrier frame thereto and for readily detaching it therefrom, the illustrated means being clamps 54 connecting the girders of the carrier frame and the girders of the supporting frame in the manner best shown in FIG. 4, screws 53 serving to tighten the clamps for attachment of the carrier frame to the supporting frame and loosening of the screws permitting the clamps to be detached and enabling the carrier frame to be removed. Four support columns 51 are mounted on carrier frame 52, two on each side of separator 10, as can be seen in FIG. 1, and these support columns support brackets 48 to which tank 22 of the centrifugal separator is affixed. Elastic supports 50, such as rubber elements or springs, are interposed between support columns 51 and brackets 48 for resiliently carrying the separator. Correct positioning of the separator in relation to receptacle 12 is facilitated by the provision of centering means, the illustrated centering means being constituted by bolts 55 passing through slots in carrier frame 52 and supporting frame 14 so that the carrier frame may be suitably positioned and fixed in this position by tightening bolts 55, whereupon clamps 54 are tightened by driving home screws 53 for securely attaching the separator to the support frame.

If desired, the rear or bottom end of tank 22 may be closed off by a solid or perforated protective cover, as shown at 57.

Large receptacle 12 is a tower of generally rectangular cross section and comprising vertical rear wall 61 and vertical front wall 63 opposite thereto. Rear wall 61 defines opening 67 and the centrifugal separator is arranged with the discharge end 13 of conical basket 16 facing opening 67 and extending slightly into the receptacle whereby the dry particles separated from the liquid in separator 10 are ejected into receptacle 12. Opening 67 in vertical wall 61 has a diameter slightly in excess of the diameter of the discharge end of the basket and this opening is defined by annular casing 28 which is removably mounted on rear wall 61 and surrounds opening 67. This annular casing surrounds the front end of tank 22 adjacent vertical wall 61 and defines therewith annular chamber 30 around the discharge end of the tank. Annular chamber 30 has an outlet conduit 32 which is connected to a suction means (not shown), permitting any washings or droplets collected in chamber 30 to be evacuated and drawn out of the chamber and preventing such debris from entering receptacle 12 with the dry solid particles.

Receptacle 12 includes circular plate 34 arranged substantially in the plane of vertical wall 61 and closing discharge end 13 of the separator basket through which the particles are ejected, the plate being coaxial with basket 16 and having a circumference slightly spaced from the circumference of discharge end 13 to define a narrow annular passage with the surrounding wall for permitting the dry particles to pass therethrough. The plate is carried by the receptacle and illustrated means for supporting circular plate 34 on opposite vertical wall 63 of the receptacle is a passageway 36 traversing the receptacle. The preferred passageway carrying circular plate 34 has a lower part constituted by frustoconical sector 37 and an upper part constituted by dehedron 39. The dihedral upper part 39 of passageway 36 has an apex at the top of the passageway and prevents the accumulation of dried particles which have been projected upwardly in the receptacle and then fall therethrough towards the bottom thereof. As best shown in FIGS. 3 and 4, passageway 36 is removably mounted in opening 69 of opposite vertical wall 63 by means of support flange 38.

Circular plate 34 supports conduit 40 for delivering the liquid-containing particulate product to the separator as well as inlet conduits 42 and 44 for delivering a purging fluid and a heating fluid into the separator basket, the conduits passing through passageway 36 and circular plate 34 into the interior of the basket.

As best shown in FIG. 4, circular plate 34 defines a port and hatch 46 is mounted over the port and makes it possible to look into the interior of the separator basket at all times. As shown in chain-dotted lines in FIG. 3, the hatch may be pivoted upwardly to open the port, the hatch being hingedly mounted on plate 34 and a lock 47 mounted on conduit 40 holding the hatch in the open position.

Since, as explained hereinabove, the separator is resiliently mounted, the spacing between discharge end 13 of conical basket 16 and annular casing 28, on the one hand, and circular plate 34, on the other hand, and between the discharge end of tank 22 and annular casing 28 must be sufficient to prevent any contact between the resiliently mounted parts and the stationary parts, taking into account the maximum oscillations permitted by elastic supports 50.

In accordance with this invention, centrifugal separator 10 is removably mounted on supporting frame 14 and is displaceable with its carrier frame 52. During displacement, the resilient suspension of the separator on the carrier frame is blocked by tightening screw bolts 56 which interconnect respective flanges on brackets 48 and support columns 51 wherebetween elastic supports 50 are mounted, thus effectively deactivating these supports.

As shown in FIG. 1, supporting frame 14 comprises bracket means 58 for suspending large receptacle 12 on the supporting frame. FIG. 2 illustrates a preferred embodiment of the receptacle which is of rectangular cross section and whose four vertical walls are constituted by framework 60 to which wall elements or panels 62 are affixed to form the walls of the receptacle. These wall panels may consist, if desired, of elastic fabric or thin sheet metal. Stiffening elements for the vertical walls connect portions thereof adjacent annular casing 28 and supporting flange 38, respectively, to supporting frame 14, the illustrated stiffening elements including straps 64 connecting front wall 61 to the supporting frame and webs 64 connecting rear wall 63 to bracket means 58. In this manner, the rigidity of the vertical receptacle walls is enhanced at the points where rigid annular casing 28 and rigid support flanges 38 are attached to the vertical walls.

The receptacle is open at the bottom along its entire length and an endless conveyor belt 68 is disposed below the open bottom of the receptacle to receive the dry particles falling therethrough onto the conveyor belt. The conveyor belt is mounted on support structure 59 and moves the dry particles to a desired location.

At its upper end, receptacle 12 has ports in communication with chimney 72 to evacuate moist air from the receptacle. The air circulation through the receptacle may be natural or it may be forced by placing a ventilator into the chimney.

Supporting frame 14 also carries mixer 74 containing a supply of the liquid-containing particulate product to be dried and the mixer has an outlet in communication with inlet conduit 40. Valve 76 is mounted in the mixer outlet and may be closed through control circuit 77 (shown in dash-dot lines in FIG. 1) from control panel 78 before the separator is disconnected to prevent delivery of product through conduit 40. The control panel is arranged in the installation near the outlet point of the dry particles at the bottom of receptacle tower 12 and includes controls for the throughput of the product as well as the purging and heating fluids through conduits 40, 42 and 44, a throughput control valve 80 being disposed in conduit 40 and similar control valves (not shown) in conduits 42 and 44, all of which may be manually controlled from the control panel or may be suitably automated.

As has been indicated hereinabove, separator 10 is removably mounted on supporting frame 14 to enable the separator to be removed for maintenance work thereon while a reserve separator is moved into place. In the illustrated and preferred embodiment, the means for horizontally moving centrifugal separator 10 for placing the separator in position with discharge end 13 extending into receptacle 12 and for removing it without disassembling the receptacle includes track 82 mounted on supporting frame 14 and carrying trolley 84 which supports a tackle. As shown in FIG. 1, the trolley may be moved along the overhead track on its rollers and, after clamps 54 are loosened, centering bolts 55 are removed and locking screw bolts 56 are tightened, the separator with its carrier frame may be attached to the tackle and removed along track 82 to a maintenance station, and a reserve separator may then be moved in position to replace the removed separator for the continuous operation of the drying installation.

As has been indicated in FIG. 1, a light and removable footbridge 86 may be mounted adjacent front wall 63 of the receptacle to enable an operator to have access to the basket of the separator through passageway 36. Another service bridge 88, which can be reached by steps 87, permits access to the bottom of separator 10 to enable an operator or operators to position the separator and to affix it to supporting frame 14 by manipulation of screw bolts 55 and clamps 54 tightened by screws 53.

In operation and when separator 10 is in position, the product to be dried is delivered through conduit 40 to rotary distributor 17 affixed to the hub of conical basket 16. The distributor directs the product to the small diameter bottom of the basket and distributes it about the entire periphery thereof. Upon rotation of the basket by motor 24 and under the developing centrifugal force, the solid particles of the product travel along filtering screen 15 towards discharge end 13 and are finally ejected therethrough into receptacle 12 while the liquid phase of the product passes through filtering screen 15 and moves along the inside wall of basket 16 to discharge ports 11 near discharge end 13 of the basket wherethrough the liquid is received in tank 22. The lower part of the tank has an outlet conduit 19 through which the liquid in the tank is discharged, the outlet conduit being removably connected to stationary pipe 21 by flexible coupling sleeve 23.

By way of example, an installation of the hereinabove described type has been used for drying cane sugar crystals, with receptacle 12 having square vertical walls of a dimension of 6×6 meters, and a separator basket having a discharge end of one meter in diameter.

Figure 5:
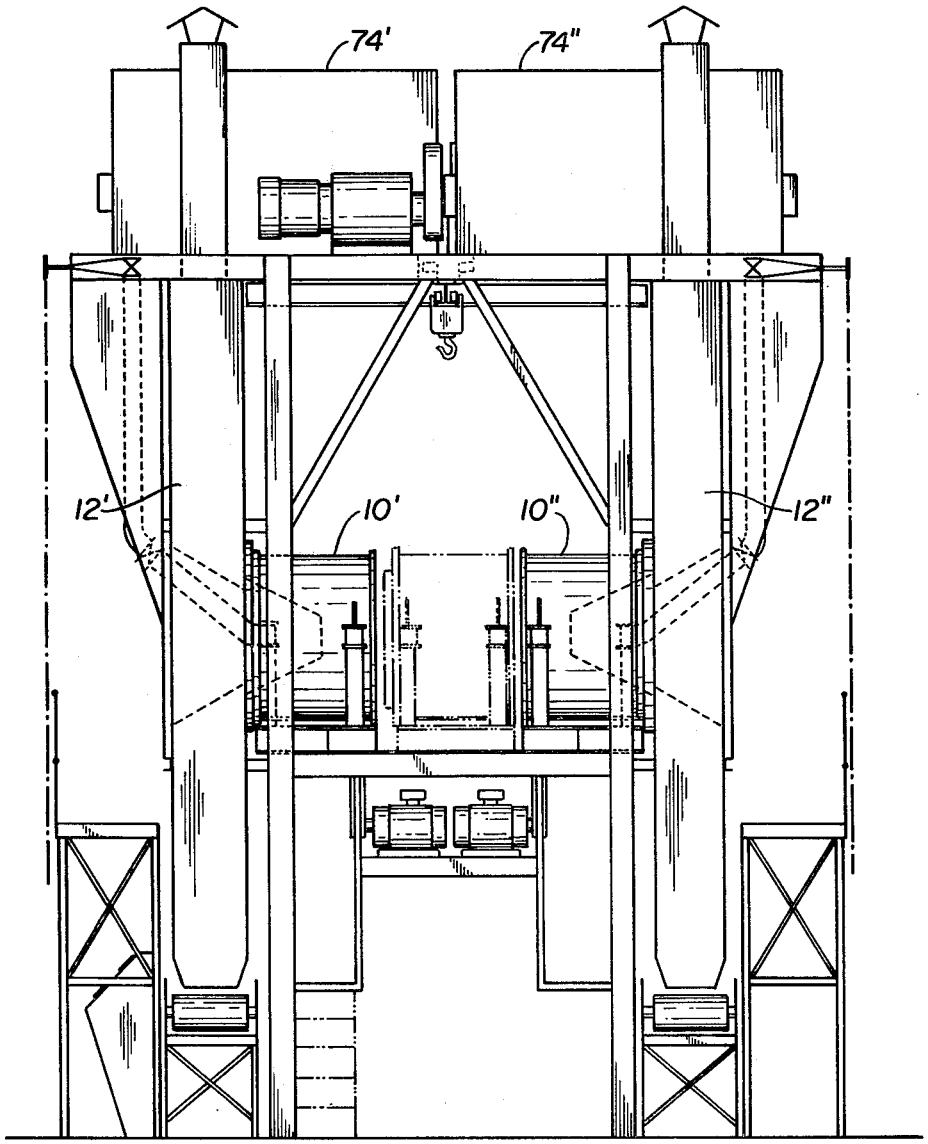
FIG. 5 is a side elevational view of another embodiment of an installation according to the present invention.

As has been schematically illustrated in FIG. 5, two like receptacle-removable separator assemblies may be mounted back-to-back on the same supporting frame, the assembly 10', 12' being fed from mixer 74' and the assembly 10'', 12'' being fed from mixer 74''. Separators 10', 10'' must be spaced apart sufficiently to permit their removal, as is indicated in chain-dotted lines in FIG. 5.

As will be evident, it is also possible to dispose several separator side-by-side on the same supporting frame, the separators being arranged at different levels to feed a single receptacle for the dry particles coming from all the separators. In this case, a corresponding number of openings are provided in the vertical rear wall of the receptacle to cooperate with the respective discharge ends of the several separators.

What is claimed is:

1. An installation for continuously drying a liquid-containing particulate product, which comprises (a) supporting frame, (b) a centrifugal separator removably mounted on the supporting frame, the separator including (1) a basket mounted for rotation about a horizontal axis and (2) a filtering screen arranged in the basket for separating the liquid from the particles of the product, the basket having a discharge end and the particles moving along the screen and being ejected through the discharge end of the basket, (c) conduit means for delivering the liquid-containing particulate product to the separator, (d) a large receptacle for the particles supported on the supporting frame, the receptacle including (1) a vertical wall defining an opening, (2) the centrifugal separator being arranged with the discharge end of the basket facing the opening in the vertical wall and extending into the receptacle whereby the particles are ejected into the receptacle, the opening having a diameter slightly in excess off the diameter of the discharge end of the basket, and (e) means for horizontally moving the centrifugal separator for placing the separator in position with the discharge end extending into the receptacle and for removing it without disassembling the receptacle.

2. The installation of claim 1, wherein the centrifugal separator includes a tank surrounding the basket and arranged to receive the separated liquid from the filtering screen, the tank having a discharge end, a casing mounted on the vertical wall and surrounding the opening, the casing defining an annular chamber around the discharge end of the tank, and evacuating means connected to the annular chamber for drawing liquid out of the chamber.

3. The installation of claim 1, wherein the large receptacle includes a circular plate arranged substantially in the plane of the vertical wall and closing the discharge end of the basket through which the particles are ejected, the plate defining a narrow annular passage with the surrounding wall for permitting the particles to pass therethrough, and means for supporting the circular plate on a vertical wall of the receptacle opposite the first-named wall.

4. The installation of claim 3, wherein the means for supporting the circular plate is a passageway having an upper part constituted by a dihedron, the dihedron having an apex at the top of the passageway.

5. The installation of claim 4, wherein the conduit means for delivering the liquid-containing particular product passes through the passageway and through the circular plate into the basket of the separator.

6. The installation of claim 3, wherein the circular plate defines a port and a hatch is mounted over the port.

7. The installation of claim 1, further comprising bracket means for suspending the large receptacle on the supporting frame.

8. The installation of claim 1, wherein the large receptacle is constituted by a framework and wall elements affixed to the framework to form the walls of the receptacle.

9. The installation of claim 8, wherein the wall elements are of elastic fabric.

10. The installation of claim 8, wherein the wall elements are of thin sheet metal.

11. The installation of claim 1, wherein the centrifugal separator includes a tank surrounding the basket and arranged to receive the separated liquid from the filter screen, the tank having a discharge end, a casing mounted on the vertical wall and surrounding the opening, the casing defining an annular chamber around the discharge end of the tank, the large receptacle includes a circular plate arranged substantially in the plane of the vertical wall and closing the discharge end of the basket through which the particles are ejected, the plate defining a narrow annular passage with the surrounding vertical wall for permitting the particles to pass therethrough, means for supporting the circular plate on a vertical wall of the receptacle opposite the first-named vertical wall, and further comprising stiffening elements for the vertical walls connecting portions of the vertical walls adjacent the casing and the plate supporting means to the supporting frame.

12. The installation of claim 1, wherein the large receptacle is closed on all sides except at the bottom thereof, and further comprising a conveyor arranged below the open bottom of the receptacle for receiving the particles ejected into the receptacle from the centrifugal separator by gravity, and for transporting the particles away from the receptacle.

13. The installation of claim 1, wherein the centrifugal separator includes a tank surrounding the basket and arranged to receive the separated liquid from the filtering screen, and further comprising a carrier frame for the separator, means for readily attaching and detaching the carrier frame to and from the supporting frame, centering means for positioning the carrier frame in relation to the supporting frame, and an elastic support means mounting the tank of the separator on the carrier frame.

14. The installation of claim 1, further comprising a mixer containing the liquid-containing particulate product and mounted on the supporting frame, the conduit means being arranged to receive the product from the mixer.

15. The installation of claim 1, comprising two of said separators mounted removably on the supporting frame back to back, two of said large receptacles being associated with the separators, the separators being spaced apart sufficiently to permit their removal.

* * * * *